US009673511B2

(12) United States Patent
Lee et al.

(10) Patent No.: US 9,673,511 B2
(45) Date of Patent: Jun. 6, 2017

(54) EXCITING DUAL FREQUENCY BANDS FROM AN ANTENNA COMPONENT WITH A DUAL BRANCH COUPLING FEED

(71) Applicant: Intel Corporation, Santa Clara, CA (US)

(72) Inventors: Kwan Ho Lee, Mountain View, CA (US); Songnan Yang, San Jose, CA (US); Anand Konanur, Sunnyvale, CA (US); Ulun Karacaoglu, San Diego, CA (US)

(73) Assignee: Intel Corporation, Santa Clara, CA (US)

( * ) Notice: Subject to any disclaimer, the term of this patent is extended or adjusted under 35 U.S.C. 154(b) by 234 days.

(21) Appl. No.: 14/492,921

(22) Filed: Sep. 22, 2014

(65) Prior Publication Data

US 2016/0087328 A1 Mar. 24, 2016

(51) Int. Cl.

| | |
|---|---|
| ***H01Q 1/24*** | (2006.01) |
| ***H01Q 1/38*** | (2006.01) |
| ***H01Q 1/44*** | (2006.01) |
| ***H01Q 13/10*** | (2006.01) |
| ***H01Q 21/30*** | (2006.01) |
| ***H01Q 5/307*** | (2015.01) |
| *H01Q 1/22* | (2006.01) |
| *H01Q 25/00* | (2006.01) |

(52) U.S. Cl.

CPC ..... *H01Q 1/243* (2013.01); *H01Q 1/38* (2013.01); *H01Q 1/44* (2013.01); *H01Q 5/307* (2015.01); *H01Q 13/10* (2013.01); *H01Q 13/106* (2013.01); *H01Q 21/30* (2013.01); *H01Q 1/2291* (2013.01); *H01Q 25/00* (2013.01)

(58) Field of Classification Search

CPC ..... H01Q 1/243; H01Q 13/10; H01Q 5/307; H01Q 1/44; H01Q 13/106; H01Q 21/30; H01Q 1/38; H01Q 25/00

USPC ..... 343/702, 770, 769, 767, 768

See application file for complete search history.

(56) References Cited

U.S. PATENT DOCUMENTS

2002/0000944 A1* 1/2002 Sabet ..... H01Q 1/36 343/770
2009/0153412 A1* 6/2009 Chiang ..... H01Q 1/52 343/702

(Continued)

FOREIGN PATENT DOCUMENTS

WO 01/52353 A2 7/2001

OTHER PUBLICATIONS

European Search Report, Application No. 15181773.1-1811 dated Feb. 17, 2016.

*Primary Examiner* — Hoanganh Le

(74) *Attorney, Agent, or Firm* — Eschweiler & Potashnik, LLC

(57) ABSTRACT

An antenna element forms a ring slot antenna comprising a first slot and second slot. The antenna element is located on a first surface of a conductive chassis that encases a body or a volume for wireless communication signals to be received or transmitted. A coupling component is located on an opposite side of the conductive chassis and behind the antenna element. The coupling component facilitates a coupling between a communication component and the antenna element as a function of the orientation and geometric shape of the coupling component to facilitate different resonant frequencies via the first and second slots of the antenna element.

24 Claims, 12 Drawing Sheets

(56) References Cited

U.S. PATENT DOCUMENTS

| | | | | |
|---|---|---|---|---|
| 2010/0321253 | A1* | 12/2010 | Ayala Vazquez .... | H01Q 1/2258<br>343/702 |
| 2010/0321255 | A1 | 12/2010 | Kough et al. | |
| 2014/0184453 | A1 | 7/2014 | Chen et al. | |

* cited by examiner

EXCITING DUAL FREQUENCY BANDS FROM AN ANTENNA COMPONENT WITH A DUAL BRANCH COUPLING FEED

FIELD

The present disclosure is in the field of wireless communications, and more specifically, pertains to exciting dual frequency bands from an antenna component with a dual branch coupling feed.

BACKGROUND

The number of antennas utilized in modern wireless devices (e.g. smartphones) are increasing in order to support new cellular bands between 600 MHz to 3800 MHz multiple-input multiple-output (MIMO), carrier aggregation, wireless local area network (WLAN), Near Field Communication (NFC), (Global Positioning System (GPS), or other communications, for example, which poses a challenge due to the volume or space required for each antenna to achieve good performance. For example, the performance of antennas in mobile phones (as among other devices) is related to the volume or space allocated and the physical placement in the mobile device or mobile phone. Increasing the allocated volume for the antenna can result in better antenna performance in terms of S11 (reflection coefficient) and radiated efficiency. The width of the display and batteries is often nearly as wide as the mobile device itself, for example, and the available volume for antennas at the circumference near these components is very limited and in many cases not usable for antennas as result of coupled interference. Other components like the USB connector, the audio jack, different user control buttons and additional receivers or transmitters, are normally also placed at the circumference, reducing the volume for the antenna even more. Therefore, it is desired to provide antenna modules with low space consumption and good performance for wireless communication devices.

DETAILED DESCRIPTION

Figure 1:
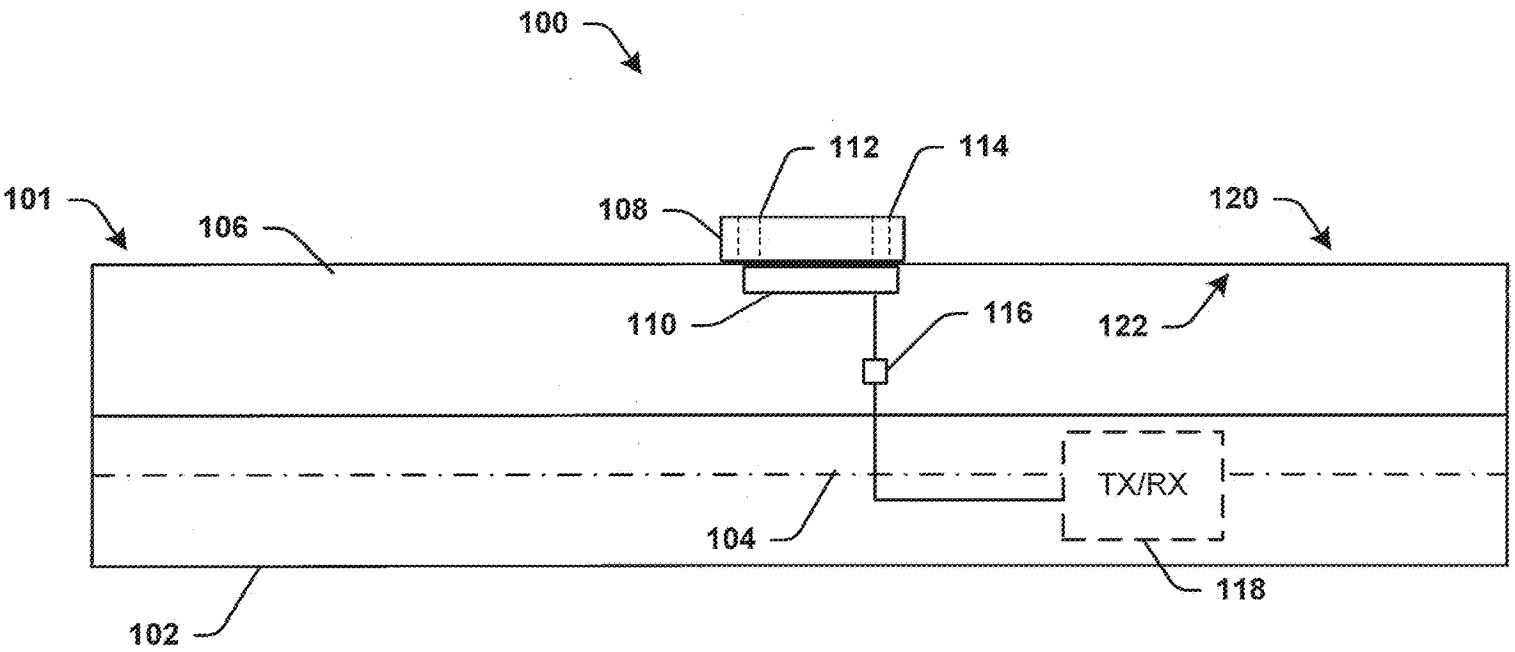
FIG. 1 is a block diagram illustrating an antenna system or device according to various aspects described.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," and the like are intended to refer to a computer-related entity, hardware, software (e.g., in execution), and/or firmware. For example, a component can be a processor, a process running on a processor, a controller, an object, an executable, a program, a storage device, and/or a computer with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the extent that the terms "including", "includes", "having", "has", "with", or variants thereof are used in either the detailed description and the claims, such terms are intended to be inclusive in a manner similar to the term "comprising".

In consideration of the above described deficiencies of radio frequency or wireless communications, various aspects for wireless devices to utilize at least one of carrier aggregation, diversity reception, MIMO operations, NFC, GPS or various other communication operations with antenna architectures having a coupler element, a coupler component feed are disclosed that can operate as an excitation component for exciting different antenna slots and as a coupling component that provides an indirect connection between the antenna and a communication component (e.g., a transmitter, a receiver or a transceiver). The antenna architectures disclosed can comprise resonant frequencies at various operational ranges. For example, an antenna element (e.g., a WLAN antenna, a cellular high band antenna, a low band antenna or the like) can operate at one or more frequency ranges, such as with a dual frequency band antenna. The antenna element can comprise a two cut ring slot antenna having two ring portions that are configured to form two ring slots for resonating at different frequencies respectively. The antenna element can be coupled to a dual branch coupling feed that resonates or excites the antenna element at different operational frequencies subsequently, concurrently or simultaneously based on different dimensions of two ring slots formed from two portions of a single slot antenna and an orientation or alignment of the coupler component with respect to the antenna element. The coupler component can operate to couple and excite both ring slots of one antenna component as a single coupling or excitation component via different branches of the coupler structure with an electromagnetic connection by facilitating an indirect coupling between the antenna element and the single coupler. Additional aspects and details of the disclosure are further described below with reference to figures.

FIG. 1 illustrates an example of an antenna system for wireless or antenna solutions to enable various different resonant elements or antenna components to operate at different frequency ranges close to one another with a single coupler element and a single antenna component. The system 100 can include a communication system that operates in a device such as a wireless device or among one or more devices for communicating with one or more of carrier aggregation, diversity reception or MIMO operations with multiple different transceivers, receivers, or transmitters for one or more different radio communication protocols.

The antenna system 100 comprises a body or an antenna volume 102 that can comprise a communication component 118 (e.g., a transceiver, receiver, transmitter or the like) located in a silicon substrate, semiconductor material, a printed circuit board or other material within a communication device 101 (e.g., a mobile device, MIMO device, personal digital assistant, or the like). The communication component 118 can further comprise a processor and a memory coupled to the processor (not shown) for processing instructions or communication signals with the coupler 110. The body 102 can comprise a circuit board with a ground plane 104, for example, a silicon body, other materials or metals that comprise at least a portion of the communication device 101. The ground plane 104 can be fabricated at least partially within, below or above the body 102 of the circuit board and be the same shape or a different shape than the body 102.

The communication device 101 further comprises a chassis 106 that can include a cover or an enclosure such as a metal or a conductive enclosure (e.g., an aluminum cover, other metal, other conductive material or a combination of metals and other conductive materials) that surrounds at least a portion of the body 102. The chassis 106 can serve to encase the body 102 and the ground plane 104 so that fewer or no antenna connections, ports or port openings are provided to an antenna element 108 via the chassis 106. The chassis 106 can encase the body 102 at a top portion and be integrated with the ground plane 104, for example, as either one body or one ground plane that comprises both the chassis 106 and the ground plane 104 as illustrated. Additionally or alternatively, the chassis 106 can encase at least a portion of the communication device 101 without providing for any direct connection or port for directly coupling the antenna element 108 to other components of the device 101. In addition, the chassis 106 can be a part of and an extension of the ground plane 104 as one and the same structure, or a separate structure. Various configurations of the communication device 101 are envisioned, in which the chassis 106 and the body 102 can be a part of a personal computing device, such as a viewing screen (e.g., LCD or the like), or a cover of the screen, a tablet, a personal digital assistant, a mobile phone surrounded by a ground plane or a screen with a ground plane inside and the chassis 106, or other configurations of a device operable for radio frequency or mobile or wireless communication signals.

The antenna element 108 can be coupled to the ground plane 104 of the body 102, either via the conductive chassis or by a separate connection or extension directly connecting the ground plane 104 within the body 102. The antenna element 108 can further correspond to or be designated to resonate at one or more frequencies or frequency ranges in one or more communication modes for various mobile or wireless communication protocols or wireless communication signals that can correspond to different networks (e.g., WLAN, cellular high band frequencies, cellular low band frequencies) controlled by a network device (e.g., Wi-Fi network device, Micro network device, Pico cell network device, etc.). Each mode, a first mode or a second mode, can comprise operation of the antenna element in one or more different frequencies. The antenna element 108 can operate to communicate as a dual resonance antenna that resonates at different frequencies or a plurality of operating frequencies within frequency ranges at different slots or ring slots within the antenna element 108. For example, the antenna element 108 can resonate at different Wi-Fi frequency bands at about 2400 MHz to about 2484 MHz as well as around 5.6 GHz, for example, in order to facilitate dual Wi-Fi communications.

The antenna element 108, or the antenna system 100 can comprise one or more cellular high band antennas, one or more cellular low band antennas, one or more wireless local access network (WLAN) antennas for communication with one or more different local networks (e.g., Local Access Network, Metro Access Network, Internet Area Network, etc.), or other type antenna that operates in a different communication protocol. A cellular high band antenna, for example, can operate at a range of about 1710 MHz to about 2690 MHz, for example. A cellular low band antenna can operate at a range of about 704 MHz to about 960 MHz, for example. A WLAN antenna can operate at about 2400 MHz to about 2484 MHz as well as around 5.6 GHz, for example. Although particular bandwidths and operational ranges of frequencies are disclosed herein for example, other frequency ranges and antenna types are envisioned as having potentially different or overlapping resonating frequencies and are also a part of this disclosure.

In one aspect, the antenna element 108 comprises a first ring slot 112 and a second ring slot 114 that operate to enable the antenna element 108 to resonate at different frequencies. The first slot 112 can comprise an opening within the antenna element 108 having a first set of dimensions that facilitate resonances at a first frequency, such as within a high frequency range (e.g., about 5 GHz or higher for a first Wi-Fi frequency range). The second slot 114 can comprise an additional opening within the antenna element 108 having a second set of dimensions that facilitates resonating at a second different or at a similar frequency (e.g., about 2.4 GHz or lower for a second Wi-Fi frequency range). Although example ranges are provided, the dimensions of the ring slots 112 and 114 can be modified to represent different frequencies within a cellular frequency range or same frequencies, as well as different dimensions or similar dimensions as one another, for example.

Additionally, the ring slots 112 and 112 of the antenna element 108 can operate to resonate separately, rather than at the same time, or configured to resonate together at the same time. Both ring slots resonating together or at the same time can operate to facilitate the antenna element 108 to resonant at a low frequency in a first mode of operation, while a second mode of operation could facilitate the antenna element 108 to resonant at a different frequency with only one of the rings slots 112 or 114, such as at a high frequency. For example, with ring slots 112 and 114 both resonating, a low frequency of about 2400 MHz to about 2484 MHz could be induced for wireless communications, and in a different mode only one ring slot 112 or 114 could cause the antenna element 108 to resonate a higher frequency such as around 5.6 GHz. Therefore, the antenna element 108 can comprise a single antenna element component that operates as a dual band antenna such as for Wi-Fi communications at two different frequency bandwidth ranges (e.g., about 2.4 GHz and 5.0 GHz).

The antenna element 108 can be an engraved ring slot antenna that is formed within the metal or conductive chassis having a plurality of portions of a ring formation structure that opposes one another to form at least two or more ring slots. A slot as used herein can comprise an opening within an antenna element so that different portions are created as a result of the spacing or opening, but is not limited herein and can also be used to identify or term the portions created by openings as slots of the antenna. The antenna element 108 can be engraved within the metal or conductive chassis 106 (e.g., an Al metal, other like metal, other conductive material or a combination thereof), or engraved at part of the ground plane 104 of the device 101 in cases where the chassis 106 and the ground plane 104 are uniformly formed as one encasing in a metal or a conductive material. The antenna element 108 can be engraved within or on a top conductive surface 120 of the conductive chassis 106. The antenna element 108 can be engraved as ring portions that include structures forming a ring above or within the top conductive surface 120. In addition, the antenna element 108 can be located above the coupler 110 at an orientation that aligns the ring slots 112 and 114 with a corresponding corner of the coupler 110.

The communication device 101 includes the coupler or a coupler feed component 110 that operates to provide an indirect or wireless connection from the antenna element 108 and the coupler 110. The coupler 110 that can operate to indirectly couple one or more frequencies at the same antenna element 108, which can operate to resonate at different frequencies via the ring slots 112 or 114 or other slots, for example. The coupler 110 can also be spaced adjacent to and just below the antenna element 108 so that the coupler 110 is located on a conductive surface of the chassis as a second or bottom surface 122 of the conductive chassis 106 with respect to an alignment or an orientation with the antenna element 108. In another aspect, the coupler 110 can be directly coupled to a feed element 116 that can include a circuit matching element or component. The coupler 110 can further be tuned or re-tuned to affect the coupling of the antenna element 108 by a modification of the physical shape of the coupler element.

The feed element 116 can operate to improve matching between a transceiver, receiver, transmitter or like communication component (not shown), and can be coupled to a transmitter, transceiver, receiver as the communication component 118 that operates to transmit or receive one or more communication signals (e.g., radio frequency signals) within a frequency range. The feed element 116 can provide the input for signals between the antenna element 108, one or more of the ring slots 112 and 114 and the communication component 118 (e.g., a receiver, transmitter, transceiver, or the like component) for transmitting and receiving communication signals.

The coupler 110 can further operate to provide a desired electromagnetic coupling (e.g., an inductive or a capacitive coupling) with the ground plane 104 (or conductive chassis 106 and ground plane 104 combined) and the antenna element 108. The feed element 116 can be in electrical communication with the communication component 118 (e.g., an antenna element, a transceiver, a receiver, transmitter or the like) and generally extend from the body 102 to the coupler 110. The feed element 116 can be formed from any suitable conductive element. In particular, a direct connection is not provided between the feed element 116 and the antenna element 108 when signals are transmitted or received thereat. Rather, the feed element 116 is configured to receive one or more signals from a transceiver or other communication component 118, and further operates to provide signals received to the coupler 110 to form an indirect, inductive or capacitive coupling with the antenna element 108.

The coupler 110 is electromagnetically coupled to the antenna element 108 or antenna components thereat, and thus allows the energy transmitted to the coupler 110 to be provided indirectly to the antenna element 108, which can then operate to resonant or communicate the signals in turn according to the ring slots 112 and 114 at one or more antenna frequencies. The performance of communications in the antenna system 100 can be affected by a capacitive or inductive coupling, for example, between the ground plane 104/chassis 106 and both the coupler 110 and the antenna element 108. Likewise, when signals are being received by the antenna element 108, the signals are then provided to the communication component 118 via the coupler 110 through electromagnetic coupling. The coupler 110 therefore enables an indirect coupling of signals being communicated to or from the antenna element 108 for transmitting and receiving communications with the system 100 at various resonant frequencies and facilitates resonating frequencies back and forth with the ring slots of the antenna independently.

In other aspects, the system 100 can facilitate the operation of multiple antennas or multiple antenna slots that operate at different or same frequency ranges within a same engraving, a same volume, a same quadrant, a same zone, a same portion or the like section of the conductive chassis 106 of the device 101 such as along a circuit board, the ground plane 104 or the conductive chassis 106 of a wireless device and as the same antenna with different slots or the same antenna. The edge, volume, quadrant, zone, portion or like section of the conductive chassis 106 can comprise a location where the antenna 108 overlays the conductive chassis 106. For example, a different antenna element or additional third ring slot that operates in a different frequency range (e.g., a low frequency range of 700 MHz to about 960 MHz, within a high frequency range of about 1710 MHz to about 2690 MHz, or at another frequency) can be fabricated next to, within or as a part of the antenna element 108 as another engraving to operate in a different frequency range of the same frequency range within a same volume or area of the chassis 106.

Engravings or additional slots within the ring structure of the antenna element 104 can operate in conjunction with the ring slots 112 and 114 to facilitate communications within a different range of frequencies than the slots 112 or 114 without having parasitic coupling effects that deter communications at the same time, concurrently, or simultaneously, for example. In one aspect, this can be facilitated by providing a single coupler element 110 that can operate to match one or more impedances of the antenna element 108 at the different ring slots, while indirectly and electromagnetically (capacitively or inductively) coupling communications from the communication component 118. The engravings or additional antenna elements can be from a slot (not shown), for example, that is formed from one or more engravings or symbols (e.g., alphabetic, numeric or other) within the antenna element 108.

In one aspect, the antenna element 108 can be formed from a logo or trademark engraved in or embedded on the conductive chassis 106 or ground plane 104. Additional markings within the logo or trademark can be portions of the same logo or trademark or a separate logo or trademark within the antenna element 108 for resonating at one or more different frequencies from slots formed thereat. For example, alphabetic, numeric or other symbol could be a different antenna element within another symbol (e.g., a ring structure with two slots) forming the antenna element 108 to resonate at two or more different frequencies concurrently or simultaneously.

Figure 2:
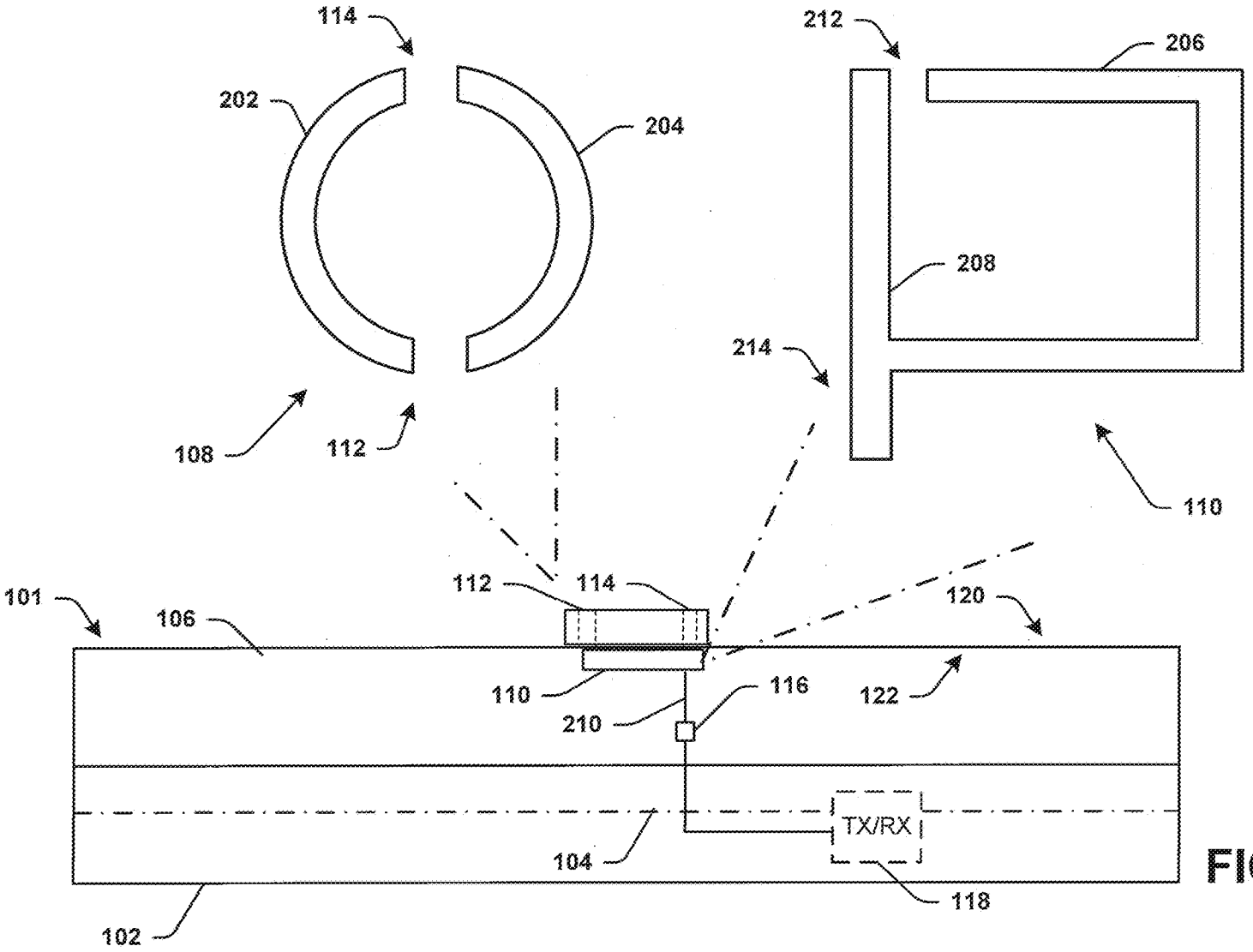
FIG. 2 is another block diagram illustrating an antenna system or device according to various aspects described.

Referring to FIG. 2, illustrated is an antenna system for communicating one or more signals with a ring slot antenna and a dual resonance coupler in accordance with various aspects described. A top view is provided of the antenna element 108 and the coupler component 110.

The antenna element 108 comprises various portions of a ring structure that include a first slot portion 202 and a second slot portion 204, which together form slot openings 112 and 114 respectively. The two ring portions 202 and 204 form a single dual resonance antenna configured to resonate at two similar or different frequencies at the same time, concurrently or at different times. The ring portions 202 and 204 can be engraved into or on the upper surface 120 and form two ring slots of the same or different dimension according to a spacing and angle of the two portions. The frequencies that the antenna 108 resonates at can be varied depending upon the dimensions of each ring slot opening 112 or 114 or of the slot portions 202 and 204.

For example, a wavelength of the operational frequency associated with a slot portion in the antenna can be represented and controlled by the geometrical dimensions of the slot portion. When a length of the slot portion 112 or 114 is close to half of the wavelength, for example, the slot resonates and radiates energy for operating as an antenna. In one aspect, the antenna element 108 can comprise a ring slot circumference of 0.5 the length of the slot that is created on the metallic or conductive surface 120 of a ground plane enclosing the device 101. The ground plane enclosure can comprise the ground plane 104 and the chassis 106. The radius of the two ring portions 202 and 204 can comprise a fraction of the wavelength, in which at least one of the rings slot portions 202 or 204 resonate at, such as a radius of about 0.08 of the wavelength. The different portions 202 and 204 of the ring structure forming the antenna element 108 can also comprise different radii while forming approximate half circles (e.g., half-ellipsoids) intended for a dual frequency operation that is excited by the coupler component 110.

As discussed above, the antenna element 108 is at least partially engraved into or located on the top surface 120 of the chassis 106, while the coupler component 110 is located on or at least partially engraved into the bottom surface of the chassis 106. The chassis 106 can serve to separate the coupler 110 and the antenna element from one another even though the two components are aligned with one another to facilitate resonances at the different ring slots of the antenna element 108. The chassis operates as a portion of the ground plane 104 and encloses the at least a top portion of the device 101. The device 101 is further without any ports or openings through the chassis 106 and ground plane 104 enclosure, which would otherwise be associated with the antenna element 108. Because the coupler component 110 operates to generate an electromagnetic coupling (e.g., an inductive coupling or a capacitive coupling), an indirect connection is generated between the antenna element 108 and the coupler component 110, which is also directly coupled via a conductive path 210 and the feeder component 116 to the communication component 118 for processing communications back and forth.

In one aspect, the coupler component 110 can comprise a single feed connection to the communication component 118 and at least a dual resonance coupling connection to the antenna element 108 for facilitating resonances at the rings slot portions 202 or 204 formed within the antenna element 108 as a ring slot antenna. For example, the coupling element 108 can have a single feed connection 210 via a feed component 116 to the communication component 118 and also provide an indirect dual connection to the ring slot portions 202 or 204 via an electromagnetic coupling, in which the coupler operates as a single feed dual resonance coupler. The coupler component 110 can be separated from physically touching the antenna element 108 by the chassis 106 and form an indirect connection via a capacitive or an inductive coupling for signal communications with one or more of the rings slot portions 202 or 204 of the antenna element 108.

The coupler component 110 can further comprise an open feed or open-ended structure that comprises a dual branch feed design. For example, the coupling component 110 can comprise an opening 212 that separates a first branch 206 from a second branch 208 in the same coupler structure. The coupler component 110 can be located behind or opposite to the antennae element 108 so that resonances can be generated with the antenna element 108 as a function of the orientation or alignment that the two components (antenna and coupler) have with one another. The coupling component 110 operates to facilitate a dual band resonating antenna 108 with the different ring slot portions 202, 204 as a function of the orientation of the coupler component 110 with respect to the antenna slots of the antenna element 108. For example, one ring slot can be coupled to a portion of the coupler component 110 differently than another ring slot, which can excite different resonances according to the orientation or alignment of the coupler component 110 with respect to the ring slot portions 202 or 204. Additional ring slots can also be envisioned as part of the antenna element 108 and configured with one or more additional openings, for example. Various orientations can be provided or altered so that different frequencies can be generating according to the orientation of the rings slot portions and openings with different portions or sections of the coupler component 110, for example.

In another aspect, the coupler component 110 can comprise a leg or extension 214 that can operate to connect the first branch 206 and the second branch 208. The leg 214 can further connect to a ground plane or the conductive path 210. The first branch 206 can comprise three different legs or extensions forming a shape similar to a portion of a box in shape, while the second branch 208 can comprise a single leg or extension that is at least partially separate from the first branch. In another aspect, the first branch 206 and the second branch 208 can comprise similar or identical lengths, such as about half of a wavelength of the resonating frequency of antenna slots or other length, for example. Alternatively, the different branches can comprise different lengths.

The coupler component 110 can operate as a dual branch structure that is an indirect coupler for providing or facilitating two (dual) resonances to the antenna element 108 by providing an alignment configuration with the slot openings 112 and 114. For example, both ring slot portions 202 or 204 can be configured to resonate together for a lower frequency bandwidth operational mode (e.g., about 2.4 GHz or the like for a low frequency Wi-Fi connection), while only one ring slot can be made to resonate for a higher frequency bandwidth operational mode (e.g., about 5 GHZ or the like for a higher frequency Wi-Fi connection). The coupler component 110 is thus configured to facilitate operation of different resonating operational frequencies of the antenna element 108 concurrently or at different times depending upon network operating conditions or network frequencies being received.

Additionally, the coupler component 110 can also operate to selectively resonate or excite one ring slot portion 204 of the antenna element 108 and resonate both ring slot portions 202 and 204 of the antenna element 108 according to one or more criteria. For example, the coupler component 110 can switch between resonating both ring slot portions 202 or 204 and only one of the ring slots based on various criteria. For example, the communication component 118 can alter or modify the impedance of the feed component 116 to facilitate the selection of the coupler component 110 to resonate one ring slot or more at a time in the antenna element 108. A strength of the frequency of a network could be a criterion that determines whether a stronger or a weaker connection could be established with both ring slots resonating on the antenna element 108 or only one ring slot or slot portion. Other criteria or factors related to establishing a low frequency Wi-Fi connection or a high frequency Wi-Fi connection, for example, or another frequency range can be determined and utilized by the communication component 118 or the coupler component 110 to select a dual resonance mode of the antenna element 108 with both ring slots operating or a single resonance mode with one ring slot operating via the coupler component 110 Both ring slots 112 and 114, for example, could be made to resonate with a selection of the low frequency Wi-Fi connection (e.g., about 2.4 GHz, lower or the like frequency) and only one ring slot portion 202 or 204 could be made to resonant with a selection of a high frequency Wi-Fi connection (e.g., about 5.0 GHz, higher or the like frequency). The criteria for the selection of operational modes (dual resonance mode or single resonance mode) can include availability of a network bandwidth, strength of the network signal, a distance or proximity of the device 101 to the network device for the network communication bandwidth, signal interference factors (e.g., geo-positioning, other devices operating on a similar bandwidth, or other interference factors), or the like. The coupler component 110 can thus be configured to also dynamically or actively select a communication mode based on one or more criteria, as well as operate as a passive antenna structure (e.g., a modified antenna ring slot structure).

In addition, the coupler component 110 can be configured to facilitate the operational mode according to an alignment or an orientation of the coupler component 110 with the different ring slot portions 202 and 204 or the antenna element 108. In one aspect, the coupler component 110 can be configured to alter the orientation by rotating portions of the coupler in an alignment with the ring slot openings 112, 114 or the slot portions 202 or 204 based on the criteria discussed above. The coupler component 110 can thus facilitate multiple different frequencies and operations to multiple different slot portions and respective openings dynamically either within a ring structure formed by the portions 202 and 204 as well as slot openings that could be engraved within the portions of the antenna ring formation, as further detailed below.

The coupler component 110 can be further configured to operate as a branch feed structure that utilizes an indirect coupling to enhance impedance matching within the broader bandwidth and branches 208, 206 of the coupler component 110 to excite resonance within the slot portions 202, 204 independently. A cable or a connection with the signal feed 116 can be provided to the coupler component 110 that comprises one or more resistances or electrical components (e.g., a capacitance or an inductance) to excite the different branches 206, 208 or different lengths within the coupler component 110. For example, the branch 208 can comprise a total length of 0.6 times the bandwidth frequency wavelength at 2.4 GHz and a shorter branch such as branch 206 can comprise a length that is 0.5 times the bandwidth frequency wavelength at 5 GHz. Alternative, the branches can comprise different lengths as a function of the operational frequency wavelength that is desired. Considering a dielectric constant of the body 102 (e.g., an FR 4 board or other like structure), the effective wavelength of the branches 206 and 208 can be shorter than that of a free space wavelength. However, the lengths of each branch can be configured to excite different frequencies such as 2.4 GHz and 5 GHz or greater at a location that includes the antenna element 108 at a logo (e.g., a 12 inch logo) as a logo slot antenna structure.

Figure 3:
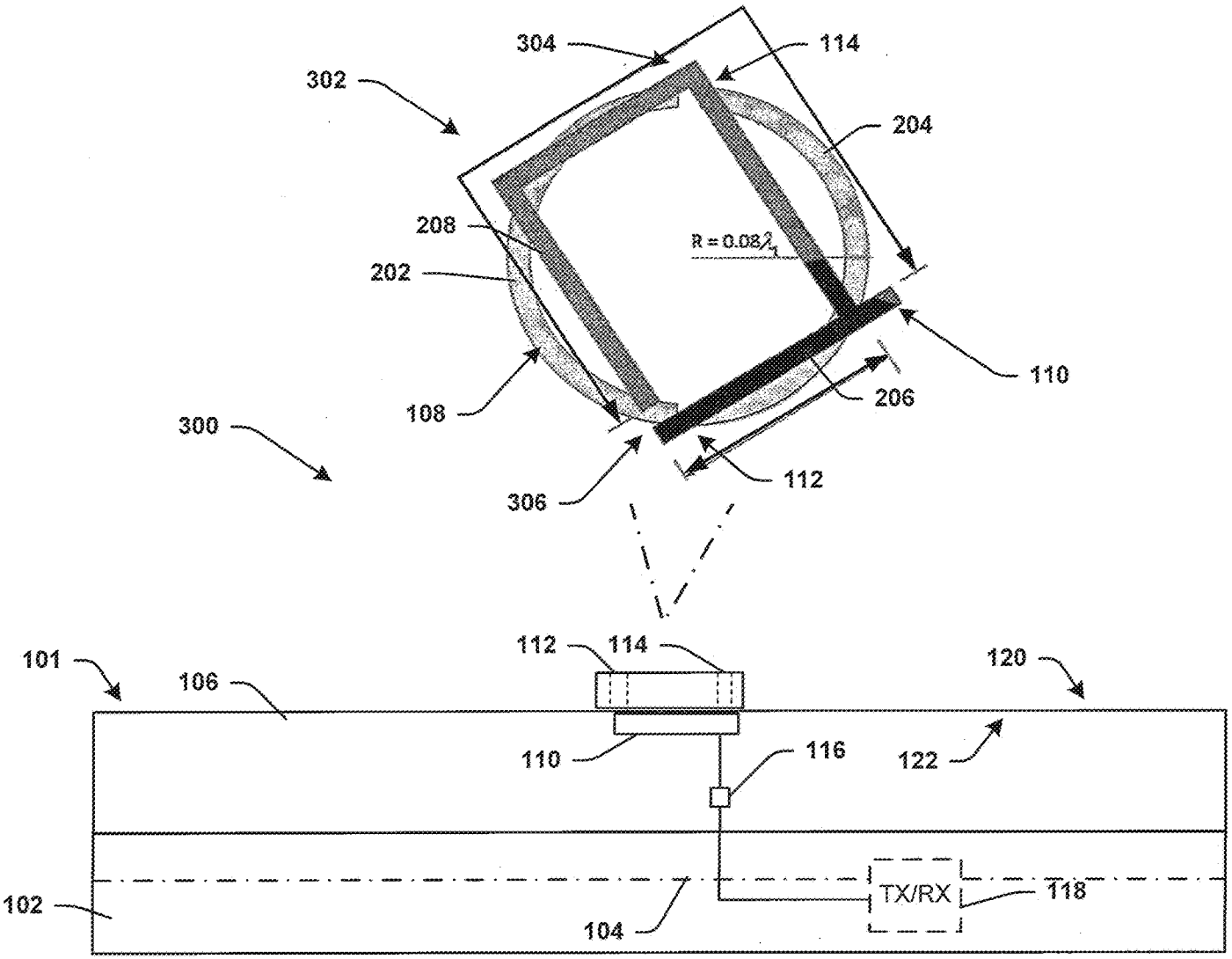
FIG. 3 is a block diagram illustrating an antenna system or device according to various aspects described.

Referring to FIG. 3, illustrated is an example of an antenna system in accordance with various aspects described. The antenna system 300 illustrates another top view of the antenna element 110 with respect to the antenna element 108. An antenna coupler orientation 302 is further illustrated that comprises an orientation, angling or alignment configuration of the coupler component 110 with respect to the antenna element 108.

The coupler component 110 and the antenna element 108 can be orientated so that the coupler component 110 can dictate different resonant frequencies concurrently or simultaneously according to the orientation 302 and with the slot portions 202 or 204. For example, the coupler element 110 can be configured with one or more corners or sections comprising a first corner 304 and a second corner 306 or section that can be positioned (via a processor and an actuator dynamically or passively at fabrication) at or below the ring slot openings 112 and 114 of the antenna element 108 for exciting the slot portions 202 or 204 independently.

The two corners, ends or sections 304 and 306 of the coupler component 110 can be aligned with the cuts or openings of the ring slots 112 and 114 respectively in order to facilitate a strong coupling due to the structural perturbation differences that occur between the corners 304 and the ring slot portions 202 or 204. As such, the coupler component 110 is configured to provide an orientation or an alignment with respect to the antenna element 108 that gives a specific angle of attachment or inducement for coupling specific resonant frequencies with the antenna element 108. Either the feed/coupling or ring rotation angle between the coupler element 110 and the ring slot openings 112 or 114 is a function of an orientation of the branch feed corner 304 or 306 at the ring slot portions 202 or 204 and the slot openings 112, 114 within the ring antenna 108. The perturbation potential for each branch 206, 208 can vary and operate to affect the rings slots differently as a result. For example, a high Wi-Fi frequency (e.g., 5 GHz or greater) could be limited to only one ring slot portion, while a low frequency operate at both ring slots depending upon the wavelength, dimensions of the rings slot portions/openings, or an orientation of the coupler component 110 (or of the corners 304 or 306 of the coupler component 110), for example. Thus, the coupler component 110 can be configured to operate between, or actively select between, operating at a low band Wi-Fi frequency or other low frequency range and a high band Wi-Fi frequency or other high frequency range as a function of a dual resonance mode or single resonance mode, for example.

In one aspect, antenna element 108 can be configured to be located on the communication device 101, which is a wireless or mobile computing device. For example, the antenna element 108 could reside on or be engraved in the encasing or aluminum chassis of an LCD panel of mobile computing device and operate to be a dual resonant antenna component for communications within a dual Wi-Fi band network coverage zone. The antenna element 108 forms a ring structure having different slots with portions 202 and 204. Each portion can be configured in an ellipsoid configuration, for example, and aligned so that the slot portions/openings are fed by the corner 304, 306, opening, or branch 206, 208 of the coupler component 110.

The antenna element 108 can also be formed, for example, from an engraved logo, a trademark or other marking that comprises one or more symbols, letters, numbers or the like as part of the ring portions. The antenna element 108 can further comprise more ring slot portions and have more than just two ring slot openings 112 and 114 within the ring structure, as well as symbols forming slots within the ring structure that can also generate different operational frequencies than the ring slots 112 and 114.

In another aspect, a parameter or criteria of the two cut ring slot antenna element 108 can comprise a dimension of the individual slots engraved on the chassis 106 (e.g., a metallic or conductive LCD cover). The operational resonance of the slot portions 202 or 204 can depend on the overall size or length adjustment of the slot openings 112 or 114 as well as of the slot portions 202 or 204. For example, a 38 mm by 25 mm size logo engraved on the chassis 106 (e.g., at 0.1 mm thick) could operate as the antenna element 108 for a Wi-Fi dual band operation (e.g., about 2.4 GHZ and about 5 GHz or greater).

The ring slot portion 204 could operate as an upper slot and the ring slot 202 as a lower ring slot, in which the portion 204 could form an outer ellipsoid at a length of about 42 mm and the other portion 202 could form an inner ellipsoid at a length of about 45 mm. Alternatively, other dimensions can also be envisioned. The wavelengths at 2.4 GHz and 5 GHz or greater in free space can be 125 mm and 60 mm respectively so that a total length is a little longer than the half wavelength (e.g., at 0.7 wavelength). Combining the ring slot portions 202 or 204 can form a dual resonance mode of operation of 2.4 GHz and either ring slot portion 202 or ring slot portion 204 alone resonating forms a single resonance mode in a different operational frequency (e.g., about 5.0 GHz, or other operational frequency). Having two slots or slot portions engraved on the metallic ground plane of the device 101 can operate to provide coverage of both Wi-Fi bandwidths, for example, and can enable IEEE 802.11 a/b/g/n/ac operation frequency bands or other different frequency bands operating as a dual mode or a single mode of operation.

Figure 4:
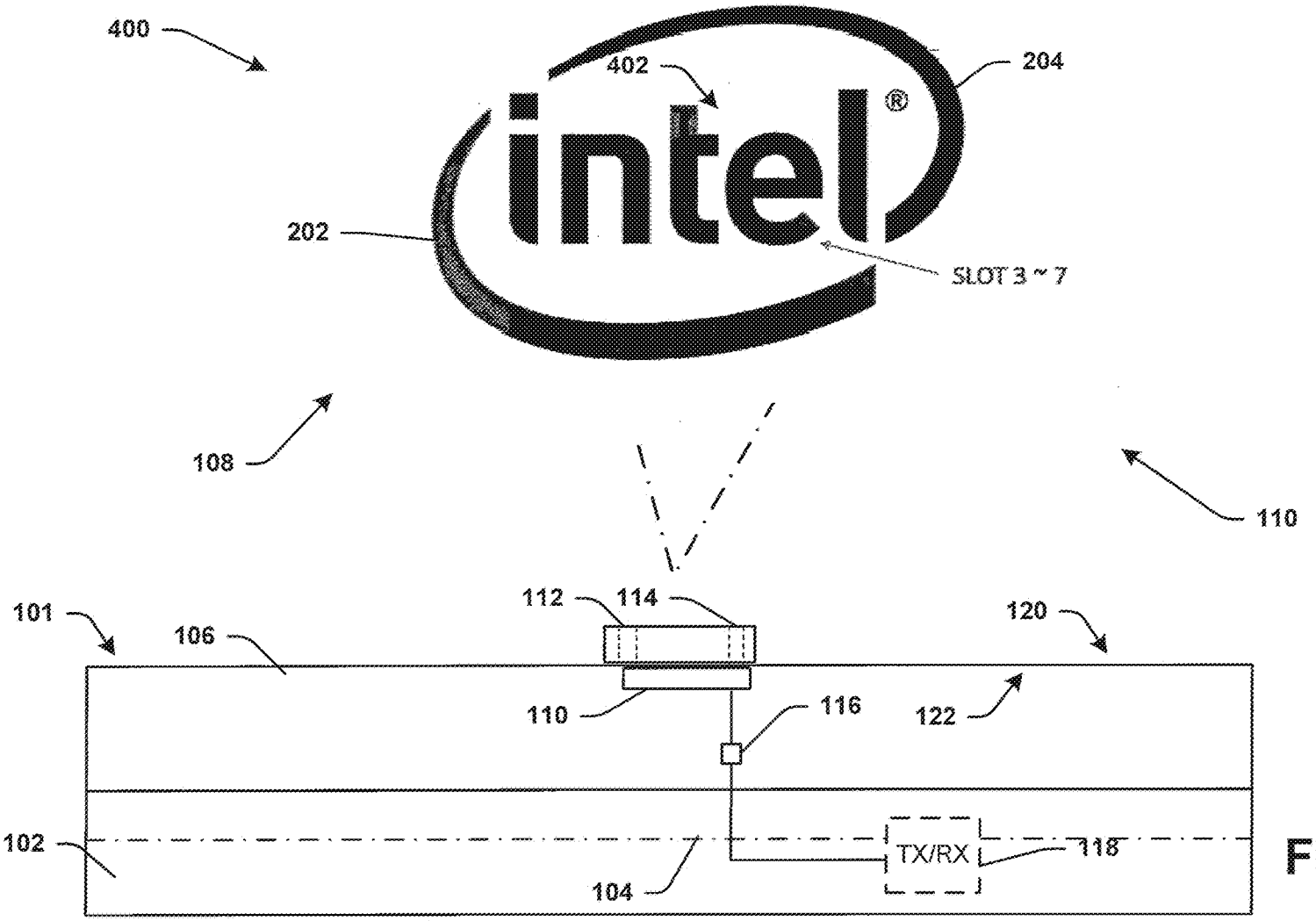
FIG. 4 is another block diagram illustrating an antenna system or device according to various aspects described.

Referring now to FIG. 4, illustrates another example of an antenna element in an antenna system 400 in accordance with various aspects described. The antenna element 108, for example, comprises a logo, a trademark, an advertisement, a marking or a pattern of symbols engraved on the chassis 106, which can be a portion of the ground plane 104 that encases at least a portion of the device 101. For example, the antenna element 108 can comprise any trademark or other insignia. The antenna element 108 can formed as a ring slot antenna within the logo, mark, or set of symbols (alphabetic, numeric, or the like) 402, in which some of the symbols or portions within the antenna element 108 can serve as additional or third antenna slots (e.g., slots 3 thru 7) for resonating at different operational frequencies than the portions 202 and 204 formed from the openings 112 and 114.

The antenna element 108 can be carved out of a ground plane 104 that can also include the conductive chassis 106 (e.g., aluminum, other metal, other conductive material, or combination of metal and conductor forming the chassis). The additional slots formed from one or more letters 402, for example, can be coupled via the coupler component 110, another indirect coupler formed within the coupler component 110, or via other coupler feeds (e.g., a directly connected coupler feed). In one example, the antenna element 108 can comprise a logo on an external surface of the conductive chassis 106, which can be approximately 12 inches in length, for example, or a different dimension for the chassis 106. A total thickness of the antenna element 108 can be about 0.9 mm or other thickness. An advantage of the antenna element 108 is that it provides a low profile functional structure that can be located anywhere on the mobile platform made out of a metallic or conductive structure. In contrast to convention flexible plastic circuit board antennas that are not all together operational behind a metallic or conductive surface due to electromagnetic field blockage from the high conductive place, the ring slot antenna element 108 operates as a dual or greater band antenna while operating as a promoting insignia or other type of insignia. Thus, the conductive enclosure platform formed with the chassis 106 and ground plane 104 does not require an opening for the antenna element 108 that can further complicate manufacturing to hide the openings or take up volume. The dual frequency band ring slots of the antenna element 108 with the coupler component 110 therefore facilitate enabling the entire casing to enclose the antenna and integrate the two without any additional opening. Although examples herein are provided for exciting a dual bandwidth Wi-Fi frequency of about 2.4 GHz and 5.0 to 5.6 GHZ, other frequencies and frequency ranges can also be excited by the coupler component 110 and the antenna element 108 as a function of an orientation of the coupler 110 with respect to the antenna element 108, the dimensions of the slots engraved within the antenna element 108 and dimensional shape and configuration of the coupler 110 itself.

Figure 5:
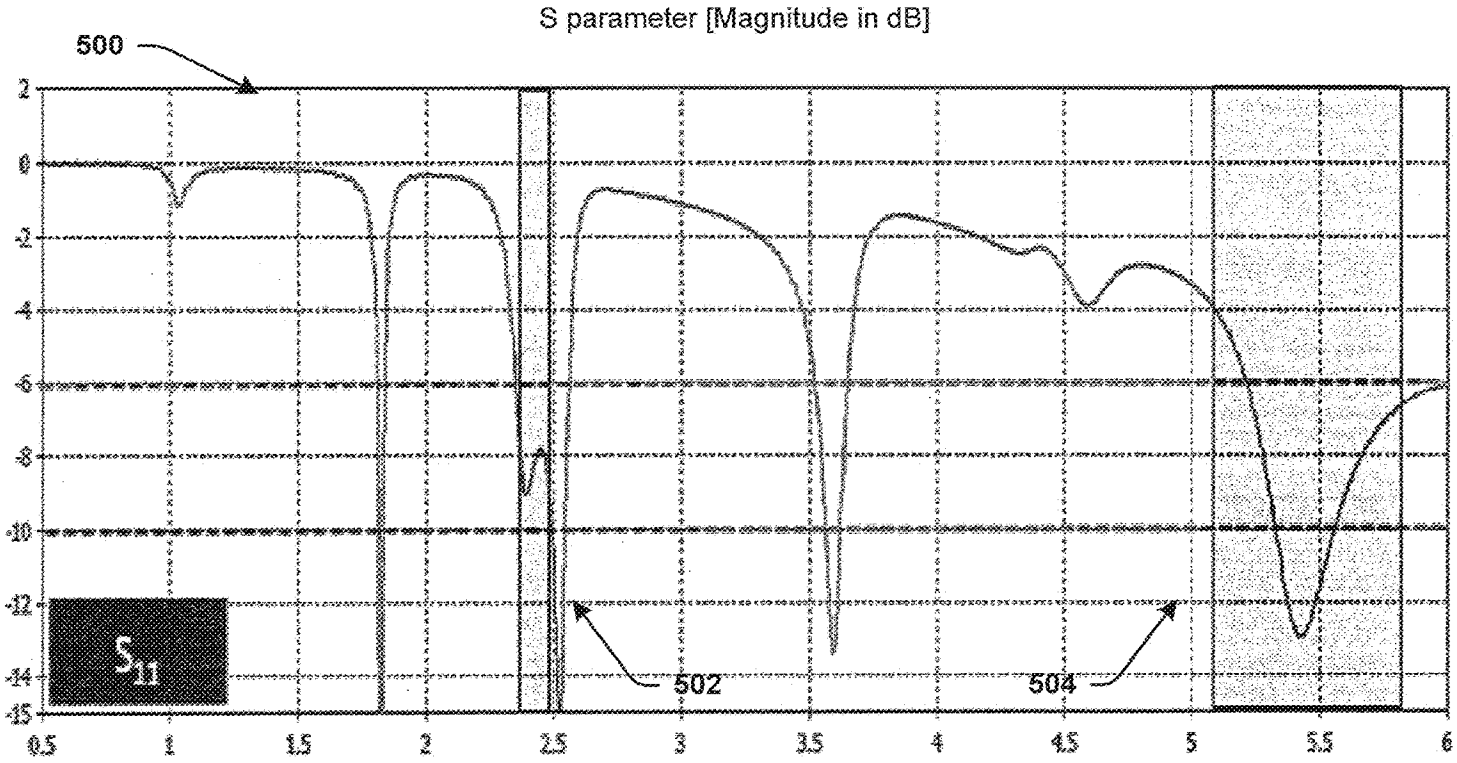
FIG. 5 is plot illustrating a reflection coefficient of an antenna system or device according to various aspects described.

Referring to FIG. 5, illustrated is a graph 500 that delineates an $S_{11}$ reflection coefficient curve that demonstrates examples of reflection in multiple bandwidths of operation. The curve 500 demonstrates the reflection coefficient magnitude in decibels (dB). The shaded regions 502 and 504 illustrate the desired Wi-Fi frequency ranges under the IEEE802.11 a/b/g/n/ac standard, for example, that the antenna element 108 resonates at in operation. The shaded region 502 demonstrates that the antenna element 108 resonates in an operational frequency range between about 2.4 and 2.5 GHz as a low frequency Wi-Fi range potentially. The low frequency Wi-Fi range can be excited or configured to operate with both ring slots 112 and 114 resonating at the same time. The shaded region 504 illustrates the frequency range covered when only one slot 112 or 114 resonates such as in a high frequency Wi-Fi range (e.g., about 5.0 GHz or greater) in the single resonance mode of operation. The ranges can be extended depending upon the configuration of an insignia or symbols engraved within the ring structure of the antenna element 108. For example, the range in the high frequency range is modified or extended by various openings in letters 402 engraved that extends the range from about 5.0 GHz to about 5.8 GHz approximately. Over the desired frequency band, the voltage standing wave ratio (VSWR) is better than 3:1, which is an accepted standard for antenna performance. Other frequency ranges can also be fabricated to be covered by the configuration of the coupler component 110 and the antenna element 108 based on the alignment, the dimensional geometry of the coupler component 110 and of the antenna element 110. Although a ring structure with insignia or symbols have been provided as examples herein, other configurations can also be envisioned that are utilized or covered by other different desired operational frequencies for communications.

Figure 6:
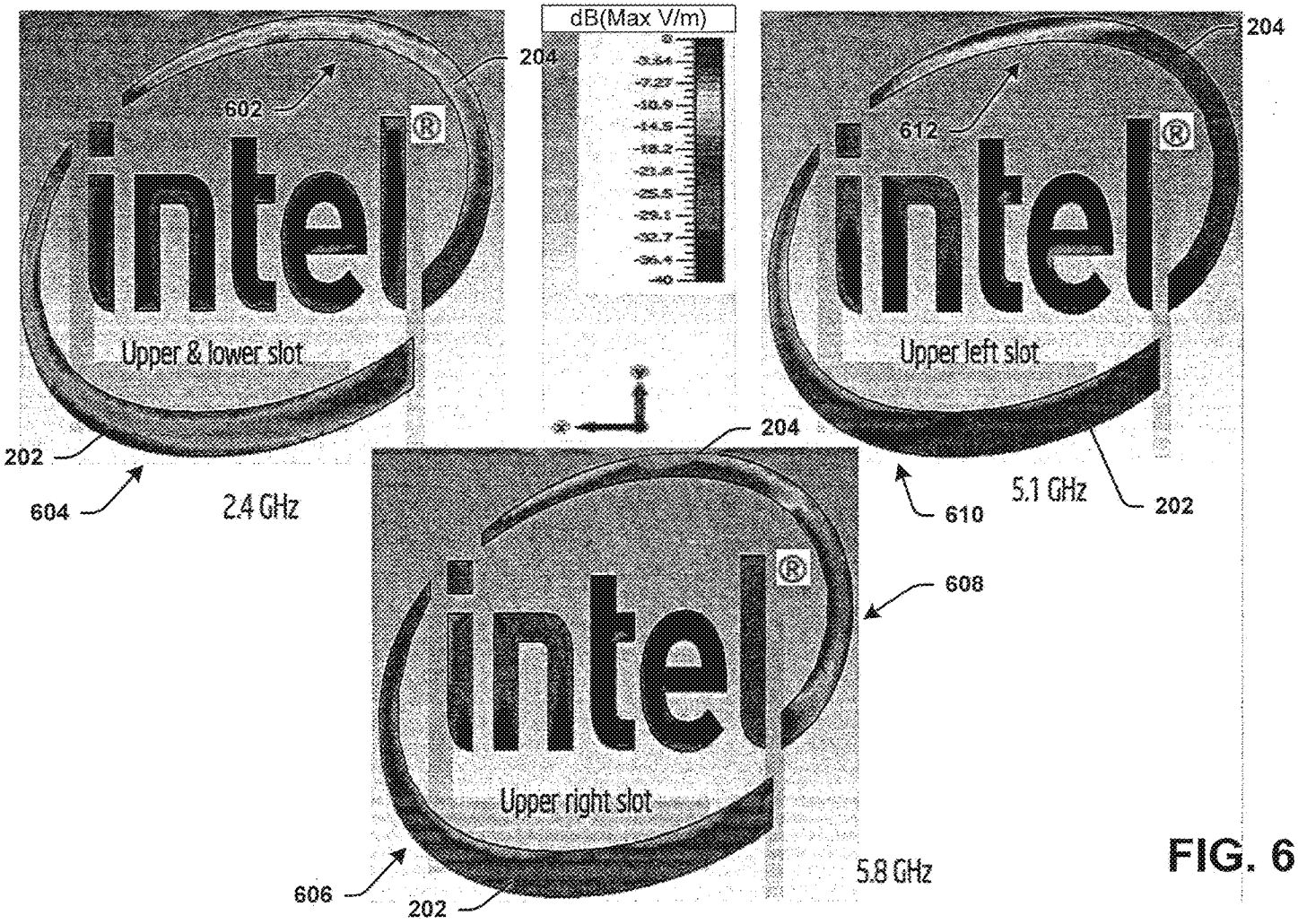
FIG. 6 is an electrical field distribution of an antenna system or device according to various aspects described.

Referring to FIG. 6, illustrated is an example of an electric field distribution cross a logo slot antenna in different frequency bandwidths. The slots portions 202 and 204 of the logo antenna element are illustrated with a color shading illustrating stronger fields expressed as lighter to darker (red) color and weaker fields being dark or bluish hues.

As indicated in the 2.4 GHz, active areas are shown by arrows 602 and 604 at both slot portions 202 and 204. This demonstrates strong electric field distributions at 2.4 GHz of both slot portions. Further, at about 5.0 GHz or about 5.1 GHz one portion of the slot portion 204 is active with strong electric field distributions within the region 612 for resonance at this frequency, while the region 610 indicates a cooler or weaker area of resonance along the slot portion 202. At 5.8 GHz, the slot portion 204 indicates actively strong electric field distributions, especially at the region 608 of the slot portion 204, but also indicates an increase in resonance at the symbols within the portions 202 and 204 (e.g., at the i, n and l letters especially) of a logo, for example. The region 606 demonstrates similar activity as region 610 at the 5.1 GHz area. As such, the symbols within the ring structure antenna can also be configured to alter the operational frequency bandwidth.

Figure 7:
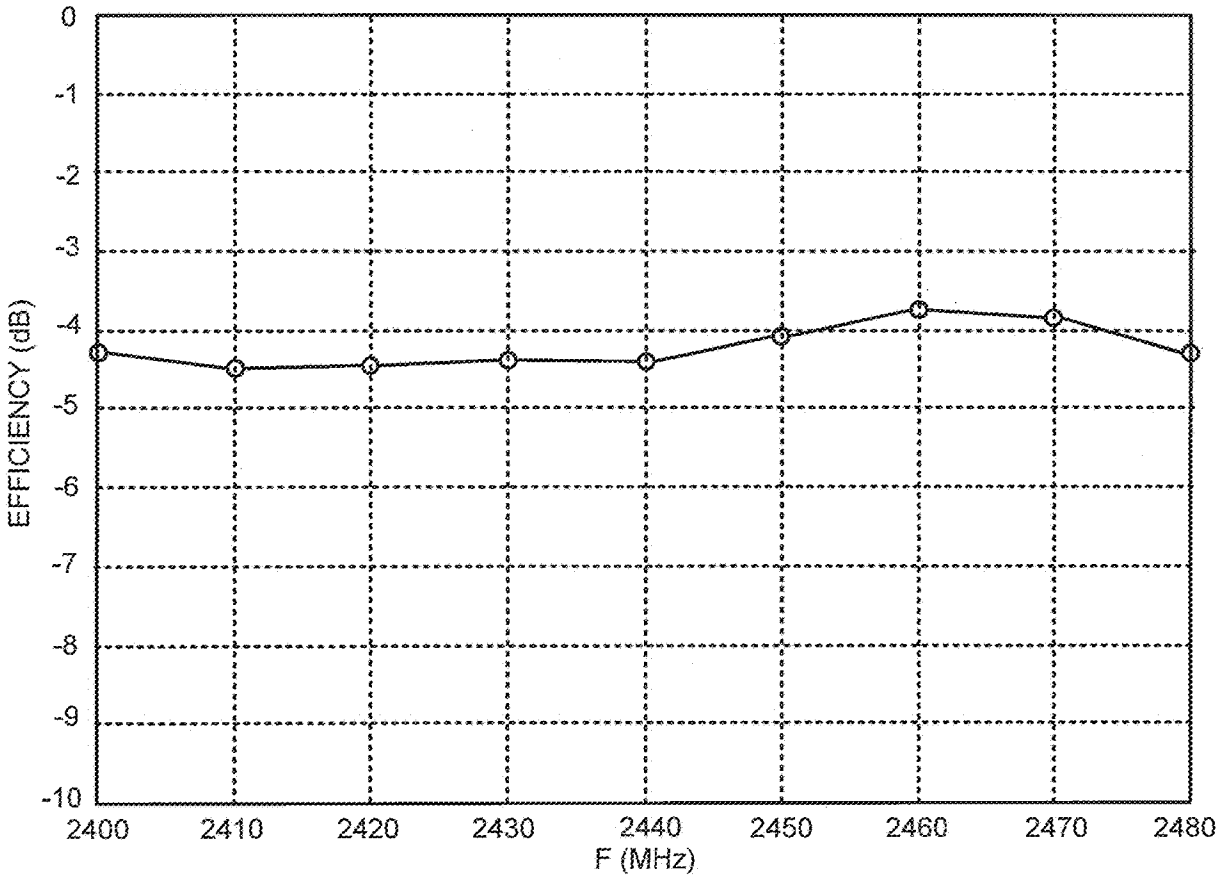
FIGS. 7-8 illustrate plots for antenna efficiencies of an antenna system or device according to various aspects described.
Figure 8:
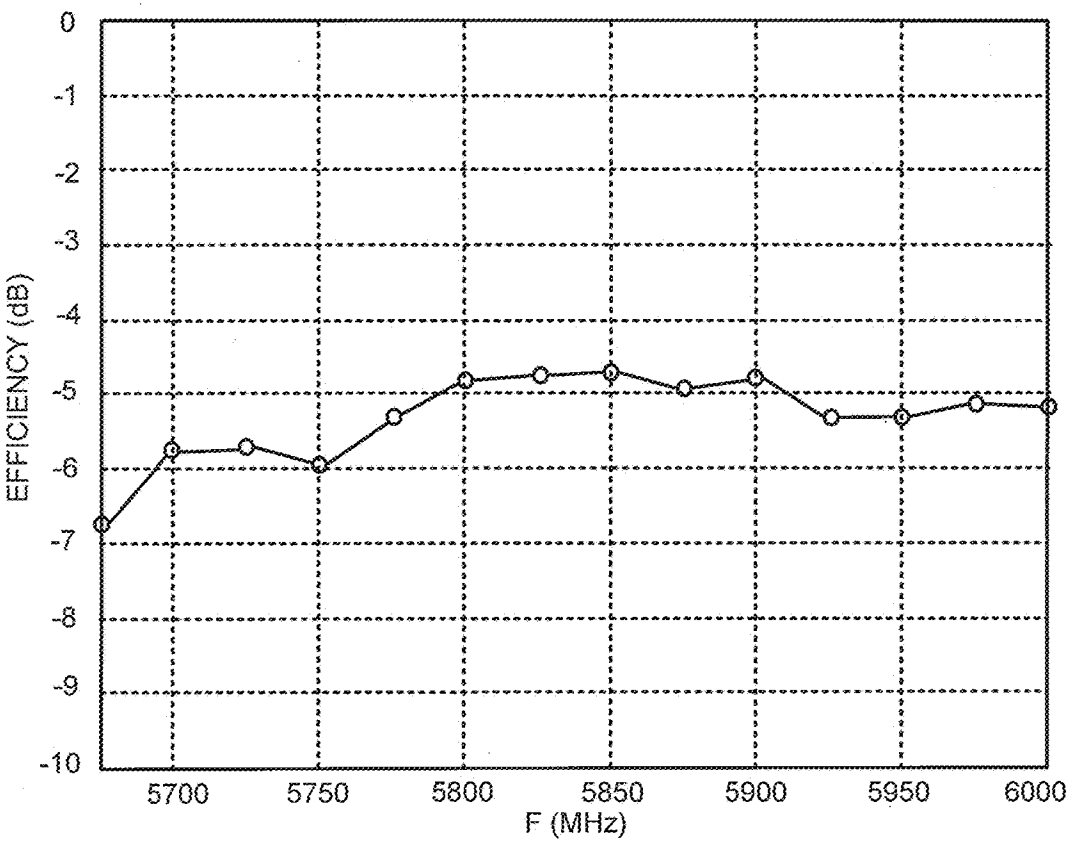
Figure 9:
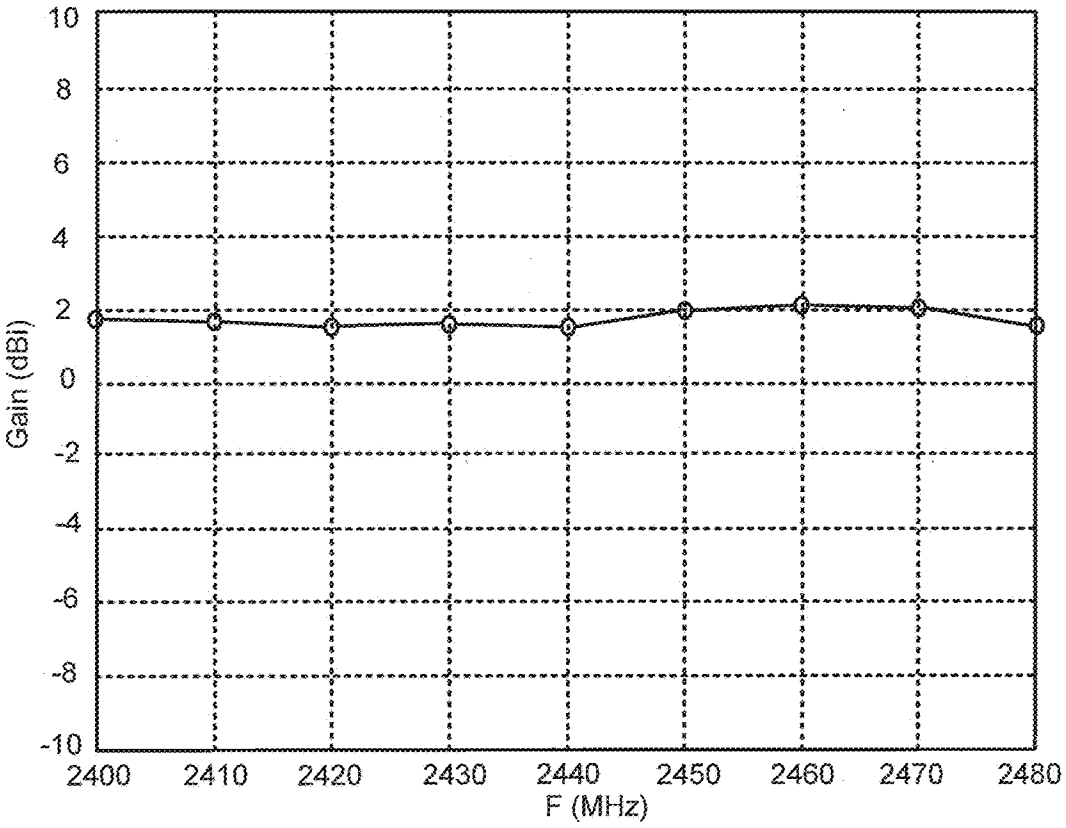
FIGS. 9-10 illustrate plots for antenna gains of an antenna system or device according to various aspects described.

Referring to FIGS. 7-9, illustrated are plots of antenna operational parameters related to the antenna element of the antenna system disclosed. FIGS. 7 and 8 illustrate plots of reasonable antenna efficiencies (measured in dB) obtained from measured frequencies of the antenna element. FIG. 7 demonstrates the antenna efficiencies measured around the 2.4 GHz band, while FIG. 8 demonstrates the antenna efficiencies measures at around about 5 GHz to about 6 GHz, for example.

FIG. 7 delineates that the efficiency at about 2.4 GHz can be around −3.7 to −4.3 dB range (equivalent to about 37% to 43% efficiency). Resonance at or near the 5 GHz band as shown in FIG. 8 is starting at 5.6 GHz and its efficiency is −4.7 to −6.7 dB range.

Figure 10:
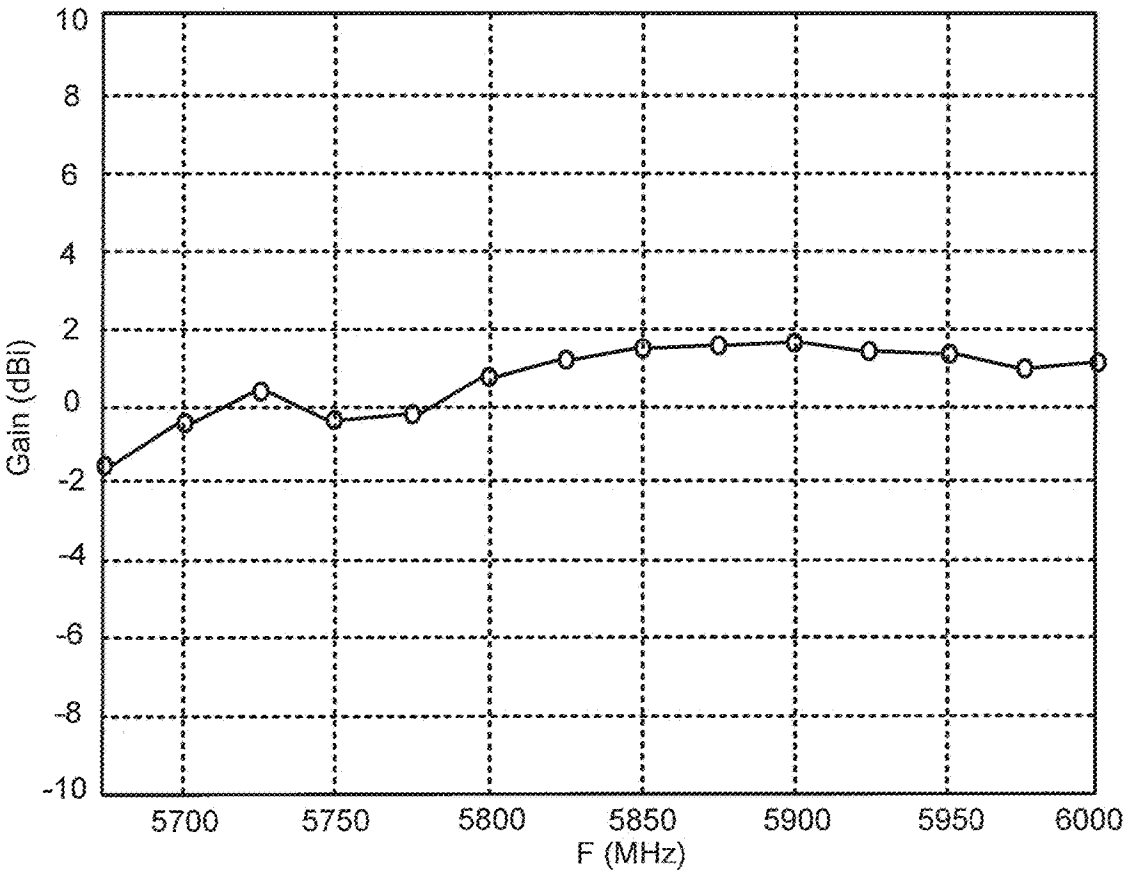

FIGS. 9 and 10 illustrate antenna gains for 2.4 GHz and about 5.0 or greater GHz bandwidths. Average gains are 1.5 dBi, which provides an excellent omni-directional coverage indicator, which can further be seen in FIG. 11.

Figure 11:
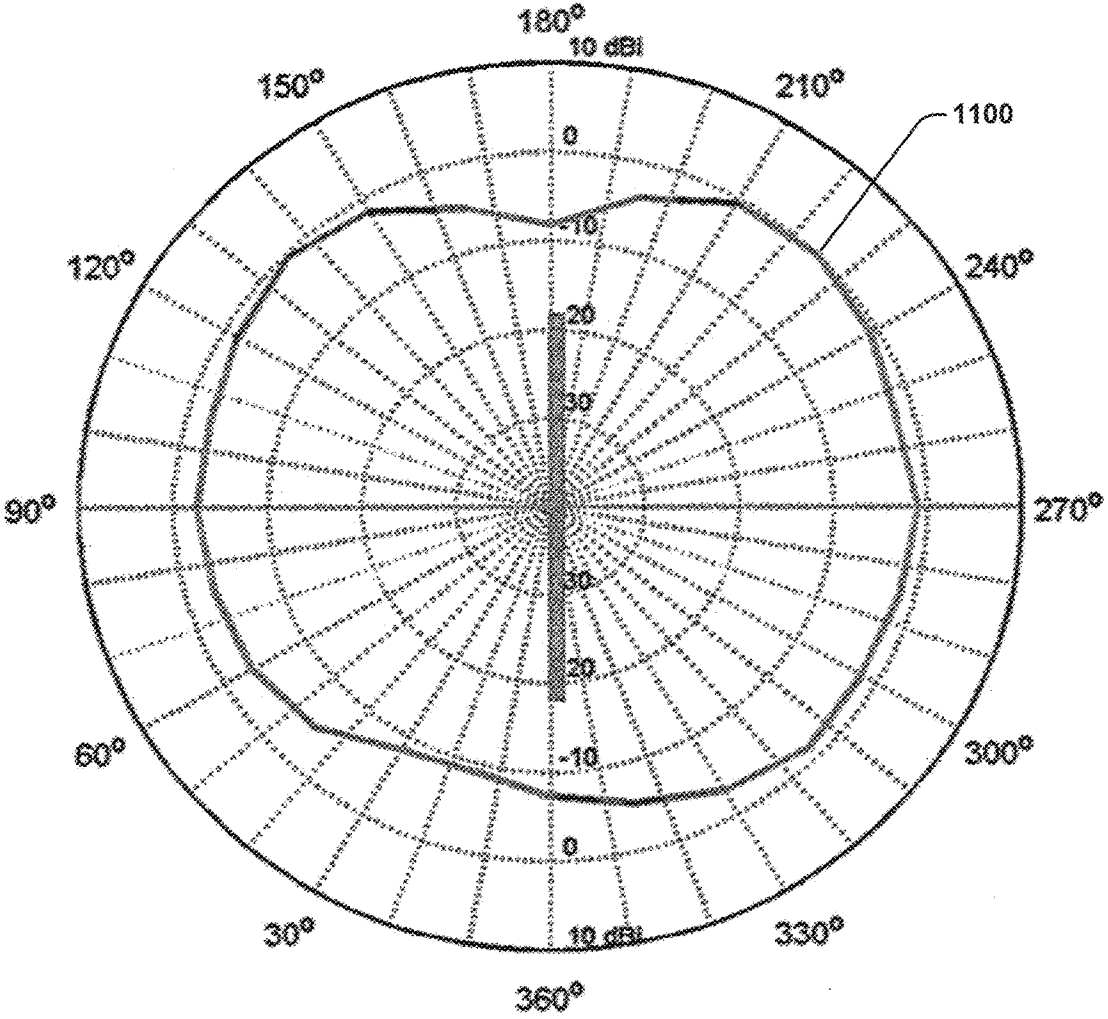
FIG. 11 is a far field radiation pattern of the antenna element in accordance with various aspects described.

FIG. 11 illustrates a far field radiation pattern of the antenna element in accordance with various aspects described. A far field pattern 1100 is delineated as far-field radiation patterns measured at about 2.4 GHz. The omni-directional coverage can be seen without any significant nulls. The ring slot on the metallic cover or conductive chassis with a coupling feed component or coupler component as described above therefore illustrates a promising antenna configuration with significant potential for operate based on an orientation with the two branch feeding structure. This antenna system as described herein can provide a low profile Wi-Fi antenna system, for example, wherever a logo could be printed on a plate. Depending on the dimension of the two cut rings, the antennas could be tuned to different frequency bands, such as GSM/LTE/WCDMMA coverage or the like.

While the methods described within this disclosure are illustrated in and described herein as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

Figure 12:
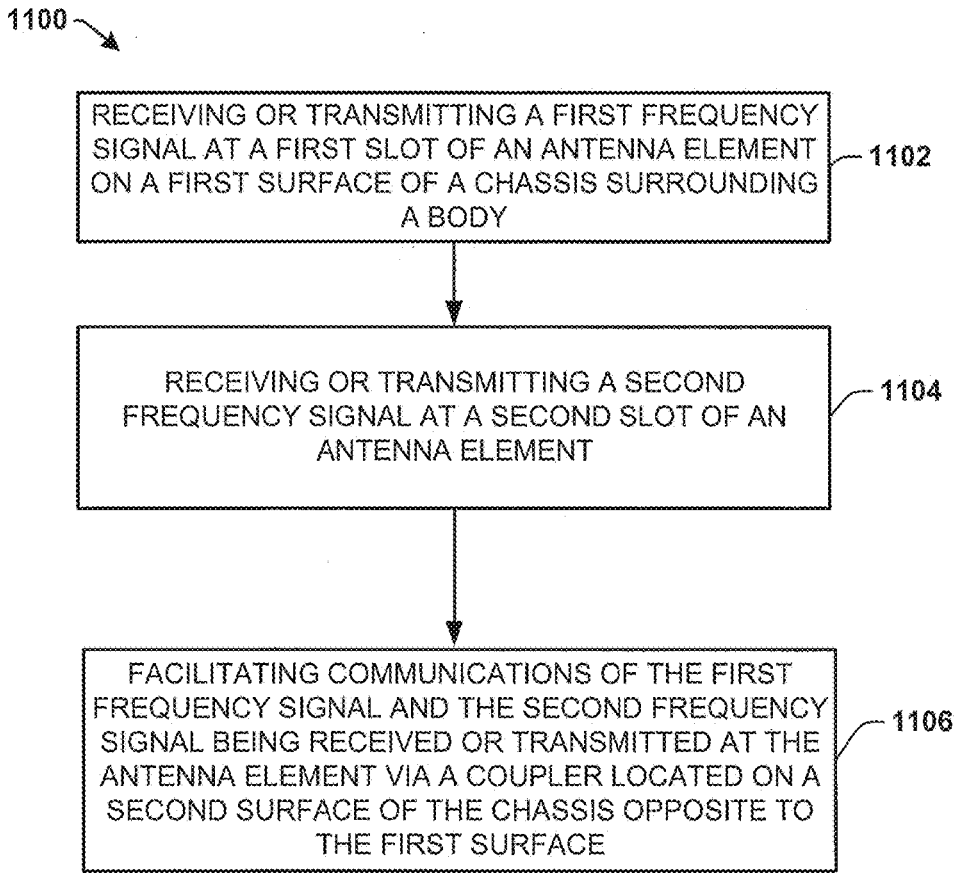
FIG. 12 is a flow diagram illustrating a method for an antenna device according to various aspects described.

Referring now to FIG. 12, illustrated is a method 1200 for operating an antenna system as disclosed herein. The method 1200 initiates at 1202 with receiving or transmitting a first frequency signal at a first slot (e.g., slot 202 or 112) of a first antenna element embedded in a first surface of a chassis (e.g., chassis 106) surrounding a body. At 1204, the method comprises receiving or transmitting a second frequency signal at a second slot (e.g., slot 204, or 114) of the first antenna element (e.g., 108). At 1206, the method comprises facilitating communications of the first frequency signal and the second frequency signal being received or transmitted at the first antenna element via a coupler (e.g., coupler 110) located on a second surface of the chassis that opposes the first surface.

The method can further comprise orientating a first branch of the coupler with a corner to align with the first slot and a second branch of the coupler with an opening to the second slot to form an electromagnetic coupling to the first antenna element. In addition, a second antenna element can be resonated or coupled via an electromagnetic coupling with the coupler. The method can further comprise receiving or transmitting a third frequency signal at a second antenna element (e.g., additional slots or symbols) located within a ring structure forming the first antenna element.

Examples can include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is a system that comprises a mobile device comprising a memory and a processor coupled to the memory for processing mobile or wireless communication signals at a plurality of operating frequencies. A conductive chassis comprises a first conductive surface and a second conductive surface opposite to the first conductive surface, and configured to cover the mobile device in a conductive material. A first antenna element is located on a first surface of the conductive chassis and configured to transmit or receive a wireless communication signal. A coupling component is located on the second conductive surface opposite to the first conductive surface and is configured to couple the first antenna element with a communication component for transmitting or receiving the wireless communication signal associated with the first antenna element.

Example 2 includes the subject matter of any of Example 1 and wherein the first antenna element comprises a ring slot antenna element.

Example 3 includes the subject matter of any of Examples 1 and 2, including or omitting optional elements, wherein the first antenna element comprises at least two ring slots formed from an first ring portion and a second ring portion of the first antenna element and configured to resonant at a plurality of operating frequencies.

Example 4 includes the subject matter of any of Examples 1-3, including or omitting optional elements, wherein the first antenna element comprises an engraving into the first surface of the conductive chassis comprising a ring slot element with a first slot and a second slot configured to resonant at a first operating frequency and a second operating frequency respectively.

Example 5 includes the subject matter of any of Examples 1-4, including or omitting optional elements, wherein the first antenna element is configured to resonant at a first resonant frequency corresponding to a first slot and at a second resonant frequency corresponding to a second slot of the first antenna element.

Example 6 includes the subject matter of any of Examples 1-5, including or omitting optional elements, wherein the conductive chassis is configured as a ground plane to wirelessly transmit or receive the wireless communication signal.

Example 7 includes the subject matter of any of Examples 1-6, including or omitting optional elements, wherein the first antenna element is configured to resonant at a first resonant frequency corresponding to a first slot and at a second resonant frequency corresponding to a second slot of the first antenna element.

Example 8 includes the subject matter of any of Examples 1-7, including or omitting optional elements, a second antenna element, located on the first surface of the conductive chassis and within the first antenna element, comprising at least one third slot configured to resonant at a different resonant frequency than the first resonant frequency and the second resonant frequency of the first antenna element.

Example 9 includes the subject matter of any of Examples 1-8, including or omitting optional elements, wherein the coupling component is further configured to couple the second antenna element with the communication component for transmitting or receiving the wireless communication signal.

Example 10 includes the subject matter of any of Examples 1-9, including or omitting optional elements, wherein the second antenna element comprises a slot antenna element configured to resonate from the at least one third slot formed from one or more letters, numbers or symbols within the first antenna element, wherein the first antenna element is a ring slot antenna element comprising the first slot and the second slot.

Example 11 includes the subject matter of any of Examples 1-10, including or omitting optional elements, wherein the first antenna element comprises a Wi-Fi antenna configured to resonate at about 2.4 GHz and about 5 GHz to facilitate dual Wi-Fi communications.

Example 12 includes the subject matter of any of Examples 1-11, including or omitting optional elements, wherein the coupling component comprises an open structure having a plurality of different branches with a first corner and a second corner, wherein the first corner and the second corner are orientated to underlie a first slot and a second slot of the first antenna element respectively.

Example 13 includes the subject matter of any of Examples 1-12, including or omitting optional elements, wherein at least two of the plurality of operating frequencies are different from one another.

Example 14 is a mobile device that comprises a communication component configured to transmit and receive mobile communications of a plurality of operating frequencies. A conductive chassis encloses the communication component with a ground plane. A first antenna element is formed on a first surface of the conductive chassis. A coupling element is formed on a second surface of the conductive chassis configured to transmit or receive the mobile communications between the first antenna element and the communication component.

Example 15 includes the subject matter of any of Example 14, including or omitting optional elements, wherein the first antenna element comprises a first ring portion and a second ring portion that form a first ring slot configured to resonate at a first resonating frequency and a second ring slot configured to resonate at a second resonating frequency.

Example 16 includes the subject matter of any of Examples 14-15, including or omitting optional elements, wherein the coupling element is configured to transmit or receive the mobile communications with the first ring slot at the first resonating frequency and the second ring slot at a second resonating frequency via an electromagnetic coupling to the first antenna element.

Example 17 includes the subject matter of any of Examples 14-16, including or omitting optional elements, wherein the coupling element comprises a first branch resonating element and a second branch resonating element coupled to the first branch resonating element that indirectly couples the first slot and the second slot of the first antenna element respectively to the communication component.

Example 18 includes the subject matter of any of Examples 14-17, including or omitting optional elements, wherein the coupler is configured as an open ended coupler comprising an opening that is aligned with a first ring slot of the first antenna element to facilitate a first resonance at a first frequency and at least one corner that is aligned with a second ring slot of the first antenna element to facilitate a second resonance at a second frequency.

Example 19 includes the subject matter of any of Examples 14-18, including or omitting optional elements, further comprising a second antenna element configured to resonate at a third frequency that is different than resonating frequencies of the first antenna element and located within the first antenna element, wherein the first antenna element comprises a first ring slot for resonating at a first resonating frequency and a second ring slot for resonating at a second resonating frequency.

Example 20 includes the subject matter of any of Examples 14-19, including or omitting optional elements, wherein the coupling element comprises a first branch resonating element and a second branch resonating element that is shorter than the first branch resonating element.

Example 21 includes the subject matter of any of Examples 14-20, including or omitting optional elements, wherein the first branch resonating element is configured to resonate a first slot of the first antenna element at a first resonating frequency and the second branch resonating element is configured to resonate a second slot of the first antenna element at a second resonating frequency.

Example 22 includes the subject matter of any of Examples 14-21, including or omitting optional elements, wherein the first resonating frequency comprises about 2.4 GHz and the second resonating frequency comprises about 5 GHz to facilitate dual Wi-Fi communications via the first antenna element.

Example 23 is a method comprising receiving or transmitting a first frequency signal at a first slot of a first antenna element on a first surface of a conductive chassis surrounding a body. The method further comprises receiving or transmitting a second frequency signal at a second slot of the first antenna element, and facilitating communications of the first frequency signal and the second frequency signal being received or transmitted at the first antenna element via a coupler located on a second surface of the conductive chassis that opposes the first surface.

Example 24 includes the subject matter of any of Example 23, including or omitting optional elements, aligning a corner of a first branch of the coupler with the first slot and a second branch of the coupler with an opening to the second slot to form an electromagnetic coupling to the first antenna element.

Example 25 includes the subject matter of any of Examples 23 and 24, including or omitting optional elements, further comprising receiving or transmitting a third frequency signal at a second antenna element located within the first antenna element.

Example 26 includes the subject matter of any of Examples 23-25, including or omitting optional elements, coupling the second antenna element via an electromagnetic coupling with the coupler.

Applications (e.g., program modules) can include routines, programs, components, data structures, etc., that perform particular tasks or implement particular abstract data types. Moreover, those skilled in the art will appreciate that the operations disclosed can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated mobile or personal computing devices.

A computing device can typically include a variety of computer-readable media. Computer readable media can be any available media that can be accessed by the computer and includes both volatile and non-volatile media, removable and non-removable media. By way of example and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media (e.g., one or more data stores) can include, but is not limited to, RAM, ROM, EEPROM, flash memory or other memory technology, CD ROM, digital versatile disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

It is to be understood that aspects described herein may be implemented by hardware, software, firmware, or any combination thereof. When implemented in software, functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if software is transmitted from a website, server, or other remote source using a coaxial cable, fiber optic cable, twisted pair, digital subscriber line (DSL), or wireless technologies such as infrared, radio, and microwave, then coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Various illustrative logics, logical blocks, modules, and circuits described in connection with aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor may be a microprocessor, but, in the alternative, processor may be any conventional processor, controller, microcontroller, or state machine. A processor may also be implemented as a combination of computing devices, for example, a combination of a DSP and a microprocessor, a plurality of microprocessors, one or more microprocessors in conjunction with a DSP core, or any other such configuration. Additionally, at least one processor may comprise one or more modules operable to perform one or more of the acts and/or actions described herein.

For a software implementation, techniques described herein may be implemented with modules (e.g., procedures, functions, and so on) that perform functions described herein. Software codes may be stored in memory units and executed by processors. Memory unit may be implemented within processor or external to processor, in which case memory unit can be communicatively coupled to processor through various means as is known in the art. Further, at least one processor may include one or more modules operable to perform functions described herein.

Techniques described herein may be used for various wireless communication systems such as CDMA, TDMA, FDMA, OFDMA, SC-FDMA and other systems. The terms "system" and "network" are often used interchangeably. A CDMA system may implement a radio technology such as Universal Terrestrial Radio Access (UTRA), CDMA2000, etc. UTRA includes Wideband-CDMA (W-CDMA) and other variants of CDMA. Further, CDMA2000 covers IS-2000, IS-95 and IS-856 standards. A TDMA system may implement a radio technology such as Global System for Mobile Communications (GSM). An OFDMA system may implement a radio technology such as Evolved UTRA (E-UTRA), Ultra Mobile Broadband (UMB), IEEE 802.11 (Wi-Fi), IEEE 802.16 (WiMAX), IEEE 802.20, Flash-OFDM, etc. UTRA and E-UTRA are part of Universal Mobile Telecommunication System (UMTS). 3GPP Long Term Evolution (LTE) is a release of UMTS that uses E-UTRA, which employs OFDMA on downlink and SC-FDMA on uplink. UTRA, E-UTRA, UMTS, LTE and GSM are described in documents from an organization named "3rd Generation Partnership Project" (3GPP). Additionally, CDMA2000 and UMB are described in documents from an organization named "3rd Generation Partnership Project 2" (3GPP2). Further, such wireless communication systems may additionally include peer-to-peer (e.g., mobile-to-mobile) ad hoc network systems often using unpaired unlicensed spectrums, 802.xx wireless LAN, BLUETOOTH and any other short- or long-range, wireless communication techniques.

Single carrier frequency division multiple access (SC-FDMA), which utilizes single carrier modulation and frequency domain equalization is a technique that can be utilized with the disclosed aspects. SC-FDMA has similar performance and essentially a similar overall complexity as those of OFDMA system. SC-FDMA signal has lower peak-to-average power ratio (PAPR) because of its inherent single carrier structure. SC-FDMA can be utilized in uplink communications where lower PAPR can benefit a mobile terminal in terms of transmit power efficiency.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical discs (e.g., compact disc (CD), digital versatile disc (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, wireless channels and various other media capable of storing, containing, and/or carrying instruction(s) and/or data. Additionally, a computer program product may include a computer readable medium having one or more instructions or codes operable to cause a computer to perform functions described herein.

Further, the acts and/or actions of a method or algorithm described in connection with aspects disclosed herein may be embodied directly in hardware, in a software module executed by a processor, or a combination thereof. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to processor, such that processor can read information from, and write information to, storage medium. In the alternative, storage medium may be integral to processor. Further, in some aspects, processor and storage medium may reside in an ASIC. Additionally, ASIC may reside in a user terminal. In the alternative, processor and storage medium may reside as discrete components in a user terminal. Additionally, in some aspects, the acts and/or actions of a method or algorithm may reside as one or any combination or set of codes and/or instructions on a machine-readable medium and/or computer readable medium, which may be incorporated into a computer program product.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature may have been disclosed with respect to only one of several implementations, such feature may be combined with one or more other features of the other implementations as may be desired and advantageous for any given or particular application.

What is claimed is:

1. A system comprising:

a mobile device comprising a memory and a processor coupled to the memory for processing mobile communications at a plurality of operating frequencies;

a conductive chassis comprising a first conductive surface and a second conductive surface opposite to the first conductive surface, and configured to cover the mobile device with a conductive material;

a first antenna element, located on the first conductive surface of the conductive chassis, comprising a first ring portion and a second ring portion forming a ring structure, wherein the ring structure comprises a first ring slot opening and a second ring slot opening between different ends of the first ring portion and the second ring portion, and configured to transmit or receive a wireless communication signal; and a coupling component located on the second conductive surface opposite to the first conductive surface and coupled to the first antenna element with a communication component for transmitting or receiving the wireless communication signal associated with the first antenna element.

2. The system of claim 1, wherein the first antenna element comprises a ring slot antenna element.

3. The system of claim 1, wherein the first ring slot opening and the second ring slot opening are configured to resonant at the plurality of operating frequencies.

4. The system of claim 1, wherein the first antenna element comprises an engraving into the first conductive surface of the conductive chassis comprising the ring structure with the first ring slot opening and the second ring slot opening to resonant at a first operating frequency and a second operating frequency respectively.

5. The system of claim 1, wherein the conductive chassis is configured as a ground plane to wirelessly transmit or receive the wireless communication signal.

6. The system of claim 1, wherein the first antenna element is configured to resonant simultaneously at a first resonant frequency corresponding to the first slot opening and at a second resonant frequency corresponding to the second slot opening of the first antenna element.

7. The system of claim 6, further comprising:

a second antenna element, located on the first conductive surface of the conductive chassis and within the first antenna element, comprising at least one third slot configured to resonant at a different resonant frequency than the first resonant frequency and the second resonant frequency of the first antenna element.

8. The system of claim 7, wherein the coupling component is further configured to electromagnetically couple to the first antenna element and the second antenna element to transmit or receive communication signals at three different frequencies concurrently.

9. The system of claim 7, wherein the second antenna element comprises a slot antenna element configured to resonate at a different frequency than a first frequency at the first ring slot opening and a second frequency at the second ring slot opening from the at least one third slot formed from one or more letters, numbers or symbols within the first antenna element.

10. The system of claim 1, wherein the first antenna element comprises a Wi-Fi antenna configured to resonate at about 2.4 GHz and about 5 GHz to facilitate dual Wi-Fi communications.

11. The system of claim 1, wherein the coupling component comprises an open structure having a plurality of different branches with a first corner and a second corner, wherein the first corner and the second corner are orientated to underlie a first slot opening and a second slot opening of the first antenna element respectively.

12. The system of claim 1, wherein at least two of the plurality of operating frequencies are different from one another.

13. A mobile device comprising:

a communication component configured to transmit and receive mobile communications of a plurality of operating frequencies;

a conductive chassis enclosing the communication component with a ground plane;

a first antenna element, formed on a first surface of the conductive chassis, comprising a ring structure with a first ring slot opening and a second ring slot opening between ends of a first ring portion and a second ring portion forming the ring structure; and a coupling element formed on a second surface of the conductive chassis configured to transmit or receive the mobile communications between the first antenna element and the communication component.

14. The mobile device of claim 13, wherein the coupling element is configured to transmit or receive the mobile communications with the first ring slot opening at the first resonating frequency and the second ring slot opening at a second resonating frequency via an electromagnetic coupling to the first antenna element.

15. The mobile device of claim 13, wherein the coupling element comprises:

a first branch resonating element; and a second branch resonating element coupled to the first branch resonating element configured to indirectly and electromagnetically couple the first ring slot opening and a second ring slot opening of the first antenna element respectively to the communication component.

16. The mobile device of claim 13, wherein the coupler is configured as an open ended coupler comprising an opening that is aligned with the first ring slot opening of the first antenna element to facilitate a first resonance at a first frequency and at least one corner that is aligned with the second ring slot opening of the first antenna element to facilitate a second resonance at a second frequency.

17. The mobile device of claim 13, further comprising:

a second antenna element configured to resonate at a third frequency that is different than resonating frequencies of the first antenna element and located within the first antenna element.

18. The mobile device of claim 15, wherein the second branch resonating element is shorter than the first branch resonating element.

19. The mobile device of claim 18, wherein the first branch resonating element is configured to resonate the first ring slot opening of the first antenna element at a first resonating frequency and the second branch resonating element is configured to resonate the second ring slot opening of the first antenna element at a second resonating frequency.

20. The mobile device of claim 19, wherein the first resonating frequency comprises about 2.4 GHz and the second resonating frequency comprises about 5 GHz to facilitate dual Wi-Fi communications via the first antenna element.

21. A method comprising:

receiving or transmitting a first frequency signal at a first slot opening of a first antenna element between first ends of a first ring portion and a second ring of a ring structure, and a second frequency signal at a second slot opening of the first antenna element between second ends of the first ring portion and the second ring of a ring structure, on a first surface of a conductive chassis surrounding a body;

facilitating communications of the first frequency signal and the second frequency signal being received or transmitted at the first antenna element via a coupler located on a second surface of the conductive chassis that opposes the first surface.

22. The method of claim 21, further comprising:

aligning a corner of a first branch of the coupler with the first slot opening and a second branch of the coupler with the second slot opening to form an electromagnetic coupling to the first antenna element.

23. The method of claim 21, further comprising:

receiving or transmitting a third frequency signal at a second antenna element located within the first antenna element.

24. The method of claim 23, further comprising:

coupling the second antenna element via an electromagnetic coupling with the coupler.

* * * * *